United States Patent [19]

Mancillas

[11] Patent Number: 4,503,317

[45] Date of Patent: Mar. 5, 1985

[54] ELECTRIC STEAM GENERATING HAIR CURLING IRON AND METHOD OF USE THEREOF

[76] Inventor: Monica M. Mancillas, 780 Thrasher Way, Anaheim, Calif. 92807

[21] Appl. No.: 548,790

[22] Filed: Nov. 4, 1983

[51] Int. Cl.[3] ..... H05B 3/00; A45D 1/04; F22B 1/28

[52] U.S. Cl. ..... 219;225; 132/7; 132/9; 132/33 R; 132/37 R; 132/112; 219/274; 219/275

[58] Field of Search ..... 219/222–226, 219/273, 274, 275, 271; 132/7, 9, 11 R, 33 R, 37 R, 37 A, 112, 118

[56] References Cited

U.S. PATENT DOCUMENTS

| | | | |
|---|---|---|---|
| 3,224,454 | 12/1965 | Quinio et al. | 132/33 R |
| 3,835,292 | 9/1974 | Walter et al. | 219/274 X |
| 3,859,497 | 1/1975 | McNair | 219/225 |
| 3,934,114 | 1/1965 | Godel et al. | 219/222 |
| 3,955,064 | 5/1976 | Demetrio et al. | 219/225 |
| 4,009,367 | 2/1977 | Rizzuto | 219/225 X |
| 4,034,201 | 7/1977 | Walter et al. | 219/222 |
| 4,065,657 | 12/1977 | Zusser | 219/225 |
| 4,097,718 | 6/1978 | Weise | 219/222 |
| 4,145,600 | 3/1979 | Walter et al. | 219/222 |
| 4,192,328 | 3/1980 | Barradas et al. | 132/37 R |
| 4,326,545 | 4/1982 | Motegi | 219/225 X |
| 4,365,140 | 12/1982 | Bast et al. | 219/225 |

*Primary Examiner*—A. Bartis

*Attorney, Agent, or Firm*—Hubbard & Stetina

[57] ABSTRACT

The permanent wave curling device of this invention comprises a vapor and heat generating hair curling iron including a handle, a mandrel and a wave solution reservoir threadably attached to the mandrel at an end opposite the handle. The handle encloses electrical circuitry necessary to control the electrical current applied to an electric heating element positioned within the mandrel. The heating element is positioned within the mandrel and receives wave solution from a rotatable rod and wick assembly that transports wave solution from the reservoir. The hair to be curled is wound about the mandrel and anchored thereto by a retaining clamp. Heat from the heating element is conducted through the mandrel to the hair in a conventional manner. The rod and wick assembly is normally spaced from the heating element and transports the wave solution from the reservoir by capillary action into the interior of the mandrel. The user may selectively rotate the rod and wick assembly by way of an actuation lever to place the wicks in direct contact with the heating element to vaporize the permanent wave solution along the length of the heating element uniformly disburse vaporized solution through the apertures in the mandrel into the hair.

8 Claims, 8 Drawing Figures

ELECTRIC STEAM GENERATING HAIR CURLING IRON AND METHOD OF USE THEREOF

BACKGROUND OF THE INVENTION

The present invention is directed toward a new method of permanently waving and styling hair and, more particularly, to an improved hand-held electrically heated curling iron having vapor generating capabilities.

As is well known, there are two general methods of waving and styling hair practiced in the prior art; i.e., permanent waving and temporary waving. The conventional permanent wave method typically consists of partitioning the hair into small areas or tresses and winding each individual hair tress about a roller. Each tress of wound hair is then wetted with a permanent wave solution, and a dome-shaped hair dryer is then placed over the hair to apply external heat to the hair, thereby activating the permanent wave solution and drying the hair. This method is typically time consuming for the stylist, generally requiring at least 30–40 roller to be placed in the hair, as well as being inconvenient and uncomfortable for the patron receiving the permanent wave. In this regard, the rollers about which the hair is wound typically pull the patron's hair, while the permanent wave solution that is applied to the hair is acidic and often causes irritation to the skin. Further, the heat applied to activate the permanent wave solution is applied about the entire head of the patron thereby necessarily producing irritation to the scalp of the patron.

In contrast to the permanent waving technique, the temporary waving technique usually involves the use of a hair curling iron adapted to grip a tress of hair of the patron. The iron is then rotated to wind the hair about the iron, and heat is applied to the hair, causing the formation of a curl when the hair is released from the iron. This prior art temporary waving method has been recently improved by the addition of steam or vapor means in the curling iron which, in addition to the heat, assist in rapidly forming a more pronounced and well-shaped curl. However, due to the curl being formed solely by heat and moisture, without the aid of a permanent wave solution, the resulting curl is temporary in duration, and the procedure often has to be repeated on a daily if not hourly basis. In addition, due to the highly acidic and corrosive nature of the permanent wave solutions, the use of such permanent wave solutions in the prior art curling irons has proven impossible.

Thus, there exists a need in the art for a hair styling apparatus such as a curling iron that can be efficiently and conveniently used while not causing undue discomfort to one desiring the hair style, yet provide a permanent wave or style comparable to the conventional method using rollers, permanent wave solution, and drying procedures.

SUMMARY OF THE INVENTION

The permanent wave curling device of the present invention provides a significantly improved method of permanently waving hair utilizing a novel construction of a hair curling iron which eliminates the deficiencies of the multiple-stage method of permanently curling hair involving numerous rollers, application of a permanent wave solution, and subsequent heating and drying of the hair.

More particularly, the invention comprises a vapor and heat generating hair curling iron consisting generally of three major components, namely a handle, a mandrel, and a wave solution reservoir. The handle includes an electrical cord and circuitry necessary to control the supply of electrical current to a heating element positioned within the mandrel. The mandrel is detachably mounted to the handle and is formed having a generally elongate tubular cylindrical configuration adapted to serve as a working surface about which the hair tress to be waved may be wound about. The reservoir is sized to store a quantity of permanent wave solution and is threadably attached to one end of the mandrel.

A heating element is positioned within the interior of the mandrel and cooperates with a rod and wick assembly which serves to transport wave solution from the reservoir to the heating element. The exterior of the mandrel is additionally provided with a plurality of apertures sized to permit the passage of vaporized wave solution from the heating element to the hair tress wrapped about the mandrel. The heating element is stationary with respect to the handle, and the rod and wick assembly is mounted for relative manual rotation such that the wicks containing the permanent wave solution may be selectively placed in direct contact with the heating element when application of the vaporized solution is desired. A cooperating clamp complementary shaped to the cylindrical configuration of the mandrel is provided to securely hold the hair in place after having been wound about the mandrel.

The method of the invention contemplates the elimination of rolling each tress of hair about separate rollers, followed by the application of permanent wave solution and then heat for setting and drying, by providing for all three steps essentially simultaneously. Basically, the hair to be curled is initially wound about the cylindrical mandrel and the retaining clamp allowed to rest on the hair, thereby anchoring the hair about the mandrel. Heat, emanating from the heating element is then conducted through the mandrel to the hair in a conventional curling iron manner. The application of permanent wave solution to the hair is accomplished by the rod and wick assembly which transports the wave solution from the reservoir by capillary action into the interior of the mandrel.

When application of wave solution onto the hair is desired, the rod and wick assembly is manually rotated by way of a small actuation lever such that the wicks are placed in direct contact with the heating element. The permanent wave solution is then rapidly vaporized along the length of the heating element, and thereby uniformly dispersed through the apertures in the mandrel and unto the wound hair. The rod and wick assembly is torsionally biased in a rotational orientation such that the wick assembly is normally spaced or separated from direct contact with the heating element. As such, when the desired amount of vaporized solution is dispersed, manual release of the actuation lever permits the biasing force to return the rod and wick assembly to its original position spaced away from the heating element. The permanent wave solution is thereby applied at an elevated temperature to the wound hair, thus eliminating the need to subsequent heating and drying to activate the solution and permanently wave the hair.

Since the permanent wave solution is corrosive, those portions of the device of the present invention in contrast with the solution are fabricated of heat and corrosive resistant materials, such as stainless steel or plastic. Certain surfaces, such as the heating element, are also advantageously coated with materials inert to the wave solution such as polytetraflouride to both protect the elements from the hot, corrosive vapor and also to provide for ease of cleaning the elements of any dried build-up of permanent wave solution. Further, the device of the present invention is designed and constructed so that it may be completely and easily disassembled for cleaning.

DESCRIPTION OF THE DRAWINGS

These, as well as other features of the present invention, will become more apparent upon reference to the drawings, wherein.

DETAILED DESCRIPTION OF THE INVENTION

Figures 1, 2, 3, 4:
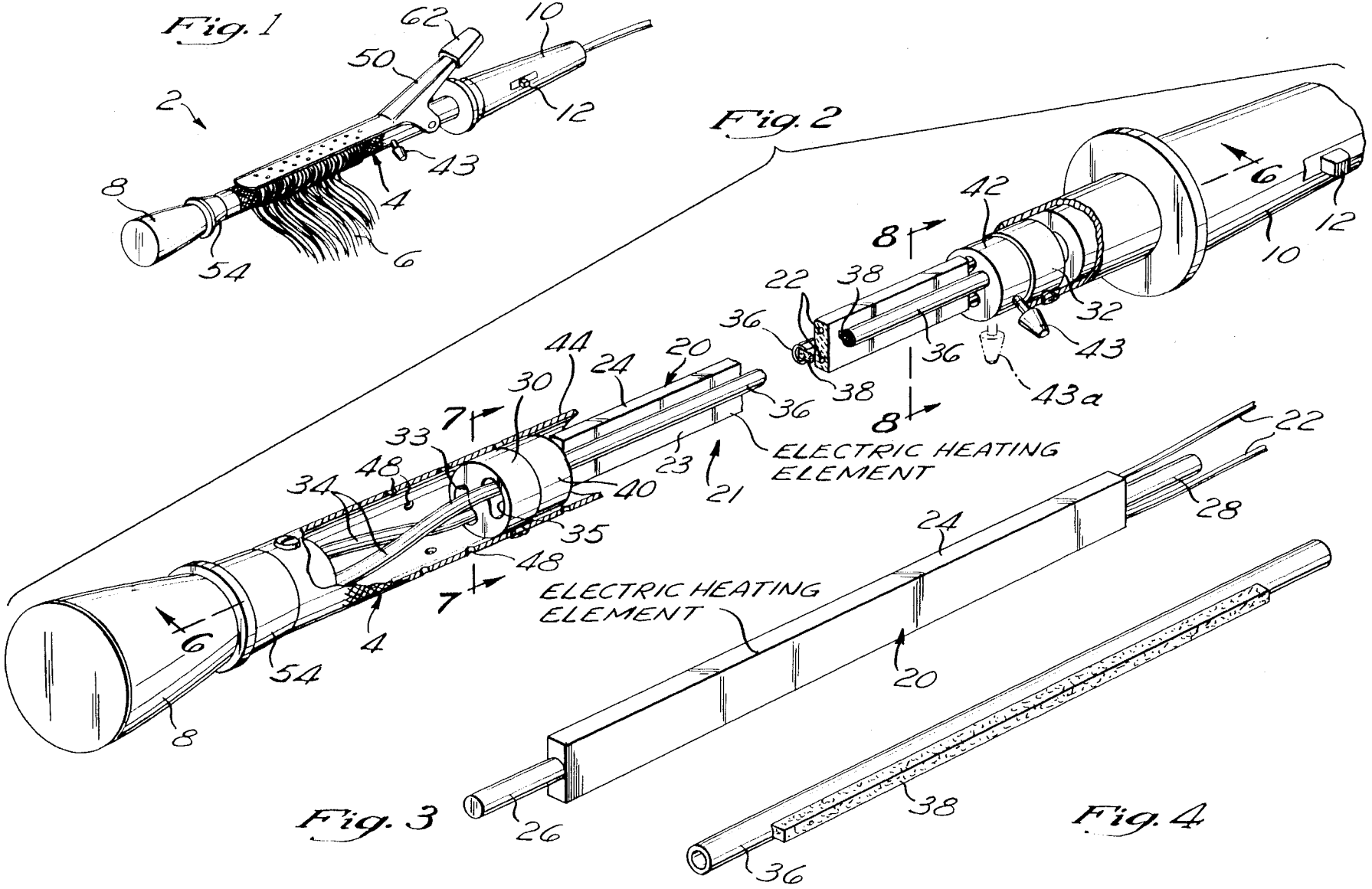
FIG. 1 is a perspective view of the method of permanently waving hair using the novel curling iron structure of the present invention.
FIG. 2 is an enlarged fragmentary view of the mandrel showing the relationship of the internal heating element and rod and wick assembly, and illustrating the manner by which the rod and wick assembly is placed in direct contact with the heating element.
FIG. 3 is an enlarged perspective view of the heating element of the present invention.
FIG. 4 is a perspective view of the rod and wick assembly of the present invention.

Referring generally to FIGS. 1–6, there is shown the improved permanent wave curling device 2 used to practice the improved method of producing a permanent wave in hair. The device 2 is comprosed generally of a mandrel 4 which houses the heat and vapor generating assemblies (collectively designated by the numeral 21) and about which the tress the hair 6 is wound, a fluid reservoir member 8, and a detachable handle 10.

The handle 10 is preferably formed from a heat resistant, and electrically insulative material and houses a conventional switch 12 which supplies electrical current to the heating element 20 of the mandrel 4. One end of the handle 10 is formed to receive two electrical terminals 14 and a pair of locator and stabilizing pins 16 of the mandrel 4 (FIG. 6). In this way, the entire mandrel 4, including the liquid reservoir 8, can easily be removed from the handle 10 as indicated by the arrows 7 and 9 in FIG. 5, so that mandrels 4 of a different diameter can be used with the same handle 10.

Referring more particularly to FIG. 2, the heat and vapor generating assemblies 21 which are mounted within the interior of the mandrel 4 of the curling device 2 of the present invention are depicted. The heat generating means of the assembly 21 is comprised of an elongated rectangular-shaped heating element 20 formed from heat-conducting material, such as ceramic, and is coated with a material 23 such as polytetraflouride for protection against the corrosive permanent wave solution and for ease of subsequent cleaning. The heating element 20 houses heat-generating resistance wire 22 disposed within a bore running approximately the length of the rectangular heating element 20 and just beneath and parallel to both narrow-width surface 24 of the heating element 20. The resistance wire 22 is permanently attached to the terminals 14 at the end of the mandrel 4. Heat is generated by the conventional resistance wire 22 in response to an electrical current supplied to the handle 10 by a conventional switch 12. To protect the resistance wire 22 from the permanent wave solution vapor, the resistance wire 22 is sealed at its entry and exit point to the heating element 20 with heat and moisture resistance material, such as silicone rubber, and is further insulated by conventional means on all other exposed portions.

Figure 7:
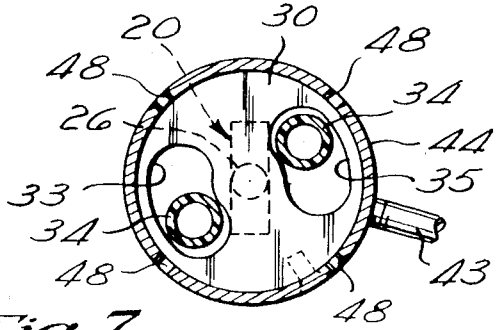
FIG. 7 is a cross-sectional view taken about lines 7—7 of FIG. 2, illustrating the manner in which the invention is constructed permitting the partial rotation of the tubular member supplying the permanent wave solution to the rod and wick assembly.

The heating element 20 includes an axial bore at both ends sized to permanently receive and mount a pair of cylindrical rods 26 and 28 (FIG. 3) preferably formed of a material such as stainless steel. A pair of stationary cylindrical sleeves 30 and 32 (FIG. 2) are axially bored to tightly receive the rods 26 and 28, respectively, and permanently affix the same within the interior of the mandrel 14, thereby maintaining the heating element 20 in a rigid pre-determined axial position within the mandrel 4. The stationary cylindrical sleeve 32 additionally is formed to permit the passage of the resistance wire 22 from the heating element 20; and the stationary cylindrical sleeve 30 additionally is formed with a pair of arcuate apertures (FIG. 7) 33 and 35 to provide clearance for the rotation of the tubular members 34.

The vapor generating means of the assembly 21 is composed of a pair of flexible torsionally resilient tubular members 34, a pair of tubular rods 36 which are formed to mount absorbent felt wicks 38, and two rotating cylindrical sleeves 40 and 42. The tubular members 34 are preloaded within the mandrel 4 in a twisted or torsional orientation during assembly thereby providing sufficient torsion to yield a continuous rotational biasing force on the rotating cylindrical sleeve 40. The rotating cylindrical sleeves 40 and 42 are formed to receive the distal ends of the tubular rods 36, and as with the stationary sleeves 30 and 32 are axially bored to receive the cylindrical rods 26 and 28 of the heating element. Thus the rods 26 and 28 serve as shafts about which the rotating cylindrical sleeves 40 and 42 may rotate. The rotating cylindrical sleeve 42 is additionally provided with an actuator lever 43 by which the rotation of the cylindrical sleeve 42 within the mandrel 4 can be manually effected. As will be recognized during rotation of the cylindrical sleeve 42, the composite assembly of the tubular rods 36 and cylindrical sleeve 40 will be simultaneously rotated.

Figure 5:
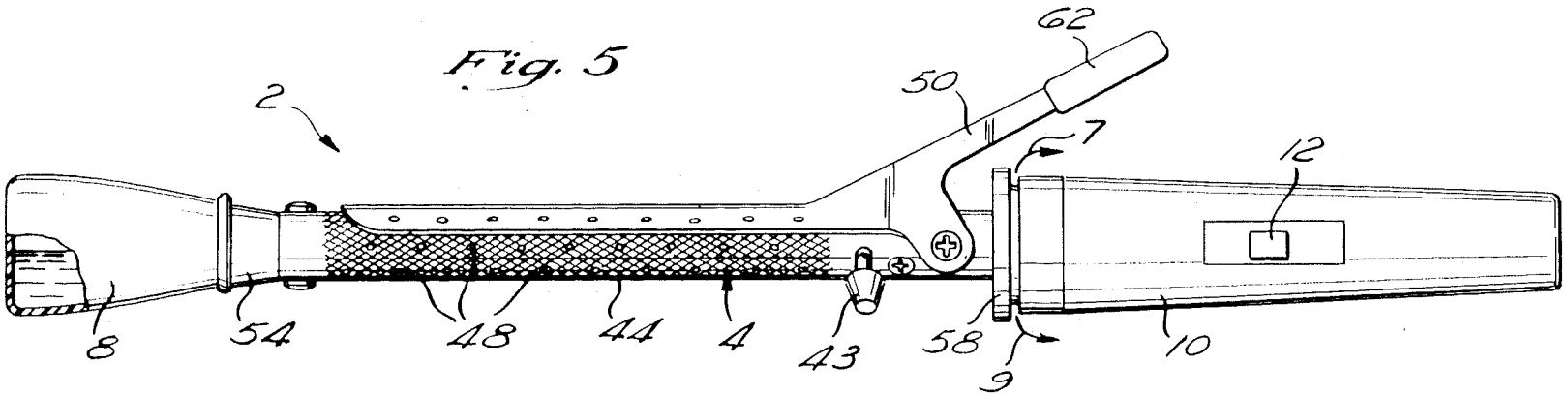
FIG. 5 is a elevational view of the hair curling iron of the present invention.
Figure 6:
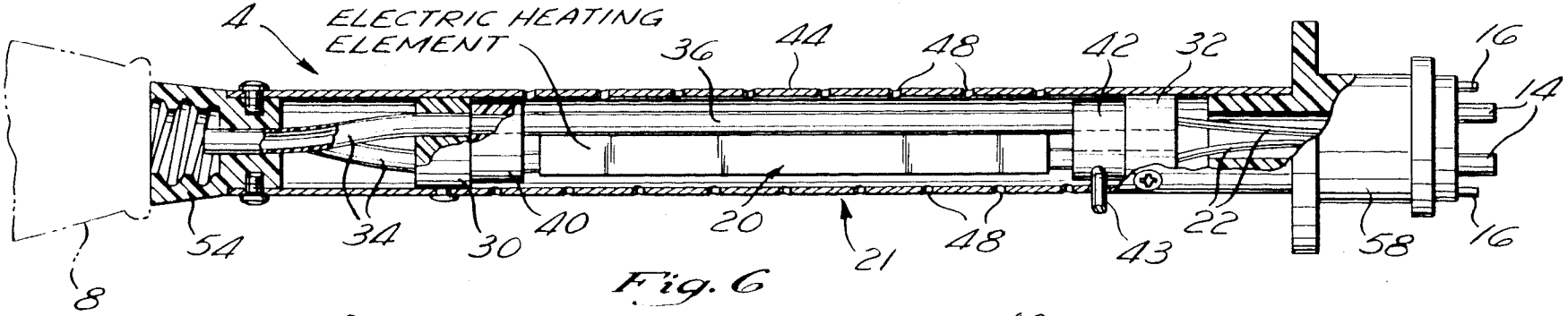
FIG. 6 is a partial cross sectional view illustrating the manner of assembling the curling iron of the present invention.

The mandrel 4 is formed in an elongate tubular configuration and as shown in FIGS. 5 and 6 is disposed between the handle 10 and reservoir 8. The external surface 44 of the mandrel 4 is includes a plurality of perforations or apertures 48 which as will be explained in more detail infra, serve to provide a passageway for vaporized permanent wave solutions eminating from the interior of the mandrel 4. A conventional restraining clamp 50 is pivotably mounted to the mandrel 4 and includes a concave configuration adapted to extend over and be biased tightly against the surface 44 of the mandrel 4. Opposite ends of the mandrel 4 are provided with an insert mount 54 adapted to receive the fluid reservoir 8 and the receptacle insert 58 adapted to be received within the handle 10.

The fluid reservoir 8, in the preferred embodiment comprises a hollow tubular shaped structure suitably formed to contain a quantity of permanent wave solution or a fluid, and having an internal flow aperature (not shown) providing an egress for the fluid into the mandrel 4. A threaded shank portion (not shown) is further provided on the reservoir 8 sized to threadably engage the insert mount 54 of the mandrel 4. The tubes 34 provide fluid communication between the reservoir 8 and the tubular rods 36 and wicks 38.

With the structure defined, the operation of the permanent wave curling device 2 and improved method of permanently waving hair of the present invention may be described. Initially, a quantity of permanent wave solution is placed within the reservoir 8 and the switch 12 is activated to cause a heating of the heating element 20. As can be seen in FIG. 1, a small tress of hair 6 may then be wound about the outer cylindrical surface 44 of the mandrel 4, and held in place by the restraining clamp 50. Prior to winding the tress of hair 6, the restraining clamp 50 of course is pivotally moved away from the mandrel 4 by depression of the pad portion 62 of the restraining clamp 50.

With the curling device 2 positioned in such a manner, the permanent wave solution contained within the reservoir 8 is free to travel through the pair of tubular members 34 and into the interior of the mandrel 4. The permanent wave solution contained within the reservoir 8 travels through the tubular members 34 into the tubular rods 36 and then to the wicks 38. Due to the elevated temperature of the heating element 20, capillary action is generated which serves to transport the fluid axially along the length of the tubular rods 36 and saturate the felt wicks 38 disposed therein. Thus, the permanent wave solution is in effect stored in the wicks 38 for selective deposition upon the heating element 20.

Figure 8:
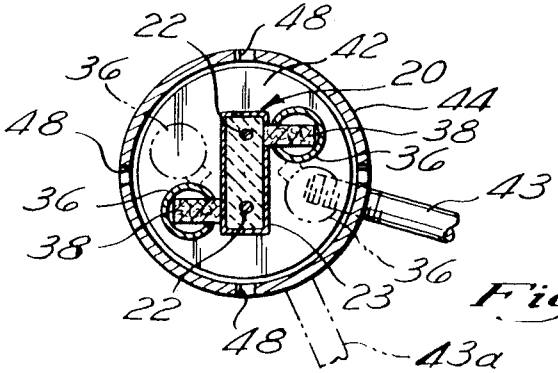
FIG. 8 is a cross-sectional view taken about lines 8—8 of FIG. 2, illustrating the manner in which the rod and wick assembly is moved from first position, as indicated the the phantom lines, to the second position in direct contact with the heating element.

Due to the torsional biasing force continuously exerted upon the rotating cylindrical sleeve 40 by the tubular members 34, the tubular rods 36 and wick 38 of the vapor generating assembly are normally maintained in a stowed or resting position and are operative by way of manual rotation of the actuator lever 34 into a operative position within the mandrel 4. In their normal resting position, the absorbant wicks 38 are spaced from the heating element 20 and hence are not in contact with the heating element 20. This condition is illustrated in FIG. 8 by the phantom lines wherein the vapor actuation lever 43 is shown in its furthermost clockwise position and the corresponding position of the tubular rods 36 and absorbent wicks 38 relative to the heating element 20. Thus, in this at rest position, the wave solution is isolated from contact with the heating element 20 and represents a non-vapor generating operation for the curling device 2.

When it is desired to apply the vaporized wave solution to the hair tress 6, the user merely rotates the actuation lever 43 in a counter-clockwise direction (as viewed in FIG. 8) causing rotation of the tubular rod 36 and wick 38 assembly into its operative or vapor generating position. As depicted by the solid lines in FIG. 8, in this operative position the absorbent wicks 38 are rotated in a counter-clockwise direction and placed in direct contact with the heating element 20, which, when due to being maintained in an elevated temperature, instantly vaporizes the permanent wave solution from the wicks 38. This hot permanent wave solution vapor immediately fills the interior of the mandrel 4 and due to pressure and conventional flow is expelled through the apertures 48 in the mandrel 4 and directly into and through the tress of hair 6 that has been wound about the mandrel 4. When a sufficient amount of hot permanent wave solution vapor has been applied to the hair tress 6, the actuation lever 43 may be released, whereby the biasing force generating by the tubular members 34 returns the vapor actuation lever 43 back to its resting position (as indicated by 43*a* in FIG. 8) and thus separates the absorbent wicks 38 from direct contact from the heating element 20, and instantly stops the further flow of vaporized permanent wave solution to the hair tress 6.

As will be recognized the combination of heat from the curling device 2 and the vaporized permanent wave solution causes the hair to be permanently waved and simultaneously dried. The tress of hair 6 is then released from the mandrel by depressing the pad 62 of the restraining clamp 50, and the next tress of hair 6 may be wound about the mandrel 4 for waving in a analgous manner. Similarly, different sized curls may be utilized by replacing the entire mandrel 4 and reservoir 8 by removing the mandrel 4 from the handle 10 and replacing with a similar mandrel 4 having a different diameter.

In summary the present invention has described a method for permanently waving hair in connection with a specific embodiment of a hair curling device having a detachable mandrel 4 containing heat and vapor generating assemblies for producing a vapor of hot permanent wave solution for easily and rapidly imparting a desired permanent wave curl to a tress of hair 6. It should be appreciated that the described embodiment of the heat and vapor producing curling device 2 having a fixed diameter is only by way of example. Various diameter mandrels and hot vapor generating assemblies of various wattages may be used to impart different curls to a tress of hair. Thus, many other arrangements can readily be devised in accordance with the described principles by those skilled in the art.

What is claimed is:

1. A hair curling device for permanently curling hair comprising:

(a) a tubular mandrel for winding hair therearound, having first and second ends and including radially extending apertures therein;

(b) a handle portion extending from the first end of said mandrel formed to be grasped by the user's hand;

(c) a reservoir for storing a quantity of permanent wave solution mounted on the second end of said mandrel;

(d) a heating element disposed with said mandrel to heat said mandrel and to permit selective vaporization of permanent wave solution to be brought into contact with said heating element;

(e) rotatable means extending within said mandrel and including a heatable vaporization portion adapted to contact said heating element for transporting solution from said reservoir into said mandrel, said transporting means having a first and second rotational position, said first position spacing said vaporization portion from said heating element and said second position disposing said vaporization portion in contact with said heating element;

(f) means cooperating with said transporting means and maintained in torsion to continuously bias said vaporization portion to said first position; and (g) an actuation lever operatively associated with said transporting means for selectively rotating said vaporization means from said first position to said second position, said mandrel, handle, reservoir, heating element, and solution transporting means formed of materials substantially inert to permanent wave solution stored within said reservoir.

2. The hair curling device of claim 1, wherein said mandrel and handle include cooperable mounting means for enabling placement of mandrels of different diameters into said handle.

3. The hair curling device of claim 1, wherein said mandrel includes a hair retaining clamp pivotally mounted thereon, said clamp having a portion extending over and biased toward the outer surface of said mandrel.

4. The hair curling device of claim 3, wherein said retaining clamp includes a finger tab extending from said extending portion.

5. The hair curling device of claim 1, wherein said mandrel includes means for supporting the said heating element, said support means including stationary cylindrical sleeves located adjacent the first and second ends of said mandrel and formed to receive rods projecting from the heating element to secure the heating element within said mandrel.

6. The hair curling device of claim 5, wherein said mandrel includes means for rotatably supporting said transport means, said support means including a pair of rotatable cylindrical sleeves located adjacent the first and second ends of said mandrel and juxtaposed to said pair of stationary cylindrical sleeves.

7. A method for producing a permanent wave in a tress of hair comprising the steps of:

(a) winding a tress of hair about a tubular mandrel of a curling device, having first and second ends and including radially extending apertures therein while grasping a handle portion of the curling device extending from the first end of said mandrel with the users hand;

(b) storing a quantity of permanent wave solution in a reservoir mounted on the second end of said mandrel;

(c) energizing a heating element mounted within said mandrel in said hair curling device utilizing an electrical switch located on said handle;

(d) transporting permanent wave solution from said reservoir into said mandrel by transporting means having first and second rotational positions, said first position spacing said transporting means from said heating element, and said second position disposing said transporting means in contact with said heating element for vaporizing the permanent wave solution;

(e) biasing said transporting means to said first position;

(f) rotating said transport means from said first position to said second position;

(g) vaporizing the permanent wave solution by rotation of said transport means from said first position to said second position to place said transport means in contact with said heating element; and forming said mandrel, handle, reservoir, heating element, and solution transporting means of materials substantially inert to permanent wave solution stored within said reservoir.

8. The method of claim 7, further including the step of interchanging mandrels of different diameters to produce different sizes of permanent waves.

* * * * *